US008308420B2

(12) United States Patent
Yagi et al.

(10) Patent No.: US 8,308,420 B2
(45) Date of Patent: Nov. 13, 2012

(54) CENTRIFUGAL COMPRESSOR, IMPELLER AND OPERATING METHOD OF THE SAME

(75) Inventors: Manabu Yagi, Tsuchiura (JP); Tadaharu Kishibe, Hitachinaka (JP); Takanori Shibata, Hitachinaka (JP); Hideo Nishida, Kasumigaura (JP); Hiromi Kobayashi, Kasumigaura (JP); Tetsuya Kuwano, Tsuchiura (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 1072 days.

(21) Appl. No.: 12/183,443

(22) Filed: Jul. 31, 2008

(65) Prior Publication Data

US 2009/0035122 A1 Feb. 5, 2009

(30) Foreign Application Priority Data

Aug. 3, 2007 (JP) ..... 2007-202576
Aug. 6, 2007 (JP) ..... 2007-204000
Apr. 25, 2008 (JP) ..... 2008-115102

(51) Int. Cl.
*F04D 27/00* (2006.01)

(52) U.S. Cl. ..... 415/1

(58) Field of Classification Search ..... 415/1, 227; 416/182, 183, 194, 223 R, 184, 188
See application file for complete search history.

(56) References Cited

U.S. PATENT DOCUMENTS 4,520,541 A * 6/1985 Miki et al. ..... 29/889.23
5,639,217 A * 6/1997 Ohtsuki et al. ..... 416/183
5,730,582 A * 3/1998 Heitmann ..... 416/188
6,905,310 B2 * 6/2005 Kawamoto et al. ..... 416/175
7,563,074 B2 * 7/2009 Xu ..... 416/185
2005/0260074 A1 * 11/2005 Higashimori ..... 415/206
2007/0077147 A1 * 4/2007 Higashimori et al. .... 416/223 R

FOREIGN PATENT DOCUMENTS

JP 60-15996 U 2/1985
JP 5-203197 A 8/1993
JP 6-173898 A 6/1994
JP 7-54796 A 2/1995

(Continued)

OTHER PUBLICATIONS

H. Harada, "Performance Characteristics of Two- and Three-Dimensional Impellers in Centrifugal Compressors", Ebara Report ASME paper 86-GT-154, 1986 w/Japanese version.

(Continued)

*Primary Examiner* — Alexander Gilman
(74) *Attorney, Agent, or Firm* — Mattingly & Malur, PC

(57) ABSTRACT

A centrifugal compressor is equipped with an impeller having a blade angle distribution that makes it possible to achieve a relatively wide operating range. The blade angle of a shroud side facing a circular plate of a blade is termed a first angle and a blade angle of a hub side disposed at the circular plate is a second. The shroud side is formed in a curved shape having an angle distribution from a front area in a shaft direction toward a centrifugal direction in which the first angle is the local maximum point before a substantially middle portion and the local minimum point after the substantially middle point. The hub side is formed in a curved shape having an angle distribution from the front area in the shaft direction toward the centrifugal direction in which the second angle is the maximum local point before the substantially middle portion.

17 Claims, 11 Drawing Sheets

FOREIGN PATENT DOCUMENTS

| | | |
|---|---|---|
| JP | 2002-021784 | 1/2002 |
| JP | 2006-2689 A | 1/2006 |

OTHER PUBLICATIONS

H. Hayami et al., "Effects of Camber of Inducer on the Performance of a Transonic Centrifugal Compressor", FED-vol. 222, Fluid Machinery, 1995 pp. 59-62 w/ Japanese Version.

VDI Berichte Nr. 1185, 1995, "A Computational Design System for Centrifugal Compressors" pp. 225-239.

Hildebrandt et al,ASME GT2006-90622 (Turbo Expo 2006), "Numerical Investigation of the Effect of Different Back Sweep Angle and Exducer Width on the Impeller Outlet Flow Pattern of a Centrifugal Compressor with Vaneless Diffuser" pp. 1-10.

JSME (B) vol. 52, No. 475, pp. 1060-1067, item 7 "Application to Centrifugal Impeller" w/English Translation, 1986.

H. Mishina, JSME (2) vol. 46, No. 402, pp. 221-231 "Study on Relative Velocity Distribution and Performance of Centrifugal Impeller" (second report) w/English Translation, Dec. 1980.

H. Mishina, JSME (2) vol. 44, No. 384, pp. 2689-2698 "Study on Relative Velocity Distribution and Performance of Centrifugal Impeller" (first report) w/English Translation w/English Translation, Aug. 1978.

D. Bonaiuti et al, ASME paper GT-2002-30619 (Turbo Expo 2002), "Analysis and Optimization of Transonic Centrifugal Compressor Impellers Using the Design of Experiments Technique" pp. 1-10.

* cited by examiner

CENTRIFUGAL COMPRESSOR, IMPELLER AND OPERATING METHOD OF THE SAME

BACKGROUND OF THE INVENTION

1. Field of the Invention

The present invention relates to a centrifugal compressor, and an impeller and an operating method of the same, particularly blade geometry of the impeller.

2. Description of the Related Art

A centrifugal compressor that compresses fluid using a rotary impeller has been widely used in a variety of plants in the related art. Recently, it has been required to enlarge the operating range for a stable operation of the impeller, due to the increased concerns in the lifecycle cost, and problems relating to energy and the environment.

The operating range for a stable operation of the impeller is determined by a surge that makes periodic change in pressure or flow rate due to increase of a recirculation area that is generated by flow separation when flow rate decreases more at a small flow rate side, and choke that does not increase any more at a large flow rate side.

The blade geometry of the impeller of the centrifugal compressor that has a large effect on the operating range, for example, as disclosed in JPA-2002-21784, is constructed on the basis of a blade angle distribution from the inlet to the outlet of a flow channel of the impeller. Therefore, the blade angle distribution is determined in consideration of both manufacturability and aerodynamic performance.

The blade angle distribution is generally determined to satisfy target specifications, such as efficiency, pressure ratio, and operating range using flow analysis or design tool, for each operation. However, in this determination, the relationship between an appropriate operating range and the blade angle distribution is not known. Accordingly, it was difficult to determine whether the operating range could be increased or not by adjusting the blade angle distribution.

As described above, since the relationship between an appropriate operating range and the blade angle distribution is not known, when the operating range for the target specifications in insufficient, in order to compensate for the insufficiency, the operating range is enlarged by adjusting the main dimensions, such as longitudinal length and diameter of the inlet of the impeller, or by applying casing treatment for increasing the operating range of the small flow rate side.

However, the main dimensions, such as longitudinal length and the diameter of the inlet of the impeller, had a larger effect on the rotor vibration as compared with the blade angle distribution, such that it was required to re-examine the design of the rotor vibration to adjust the main dimensions. Accordingly, examination items were increased, which reduced the efficiency in the design. Further, since additional process of applying the casing treatment was required to increase the operating range for the small flow rate side, manufacturing cost is increased and efficiency of performance is correspondingly decreased.

SUMMARY OF THE INVENTION

In order to overcome the above problems, it is an object of the invention to provide a centrifugal compressor equipped with an impeller having a blade angle distribution with a relatively large operating range.

In order to achieve the object, a centrifugal compressor according to the invention includes a rotary shaft, a circular plate supported by the rotary shaft, and plural blades substantially radially disposed and protruding from the circular plate, and having flow channels formed between the blades, in order to suck fluid from the front area in the shaft direction by rotating the circular plate with the rotary shaft and then discharge the fluid, which increases in pressure while passing through the flow channels, in a centrifugal direction, in which, assuming that a blade angle of a shroud side facing the circular plate of the blade is a first angle and a blade angle of a hub side disposed at the circular plate is a second angle, the shroud side is formed in a curved shape having an angle distribution from the front area in the shaft direction toward the centrifugal direction in which the first angle is the local maximum point before a substantially middle portion and the local minimum point after the substantially middle point, and the hub side is formed in a curved shape having an angle distribution from the front area in the shaft direction toward the centrifugal direction in which the second angle is the maximum local point before the substantially middle portion.

According to the above configuration, it is possible to change the area of the flow channel and accelerate and decelerate the working fluid by giving a predetermined blade angle distribution to the geometry of the blade (shroud side and hub side) of the impeller of the centrifugal compressor.

According to the centrifugal compressor having the above configuration, it is possible to provide a centrifugal compressor equipped with an impeller having a blade angle distribution that makes it possible to achieve a relatively wide operating range to solve the problems.

DETAILED DESCRIPTION OF THE PREFERRED EMBODIMENTS

First Embodiment

Figure 1A:
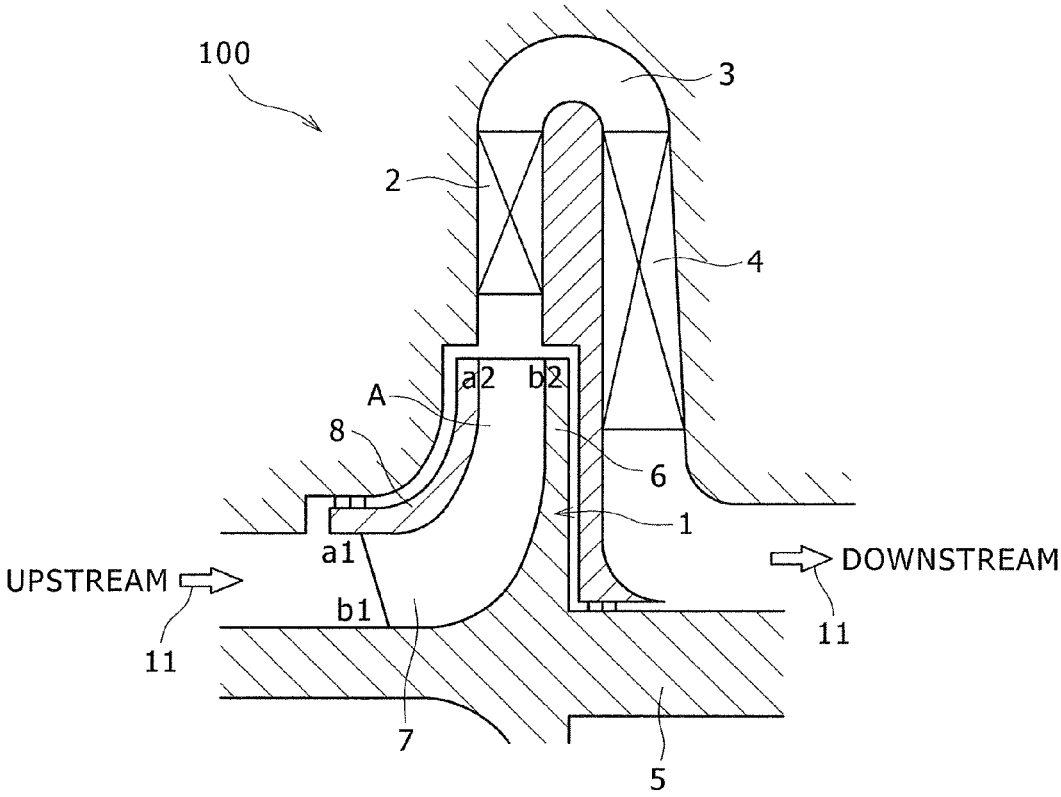
FIG. 1A is a cross-sectional vie illustrating the structure of a centrifugal compressor according to a first embodiment of the invention.
Figure 1B:
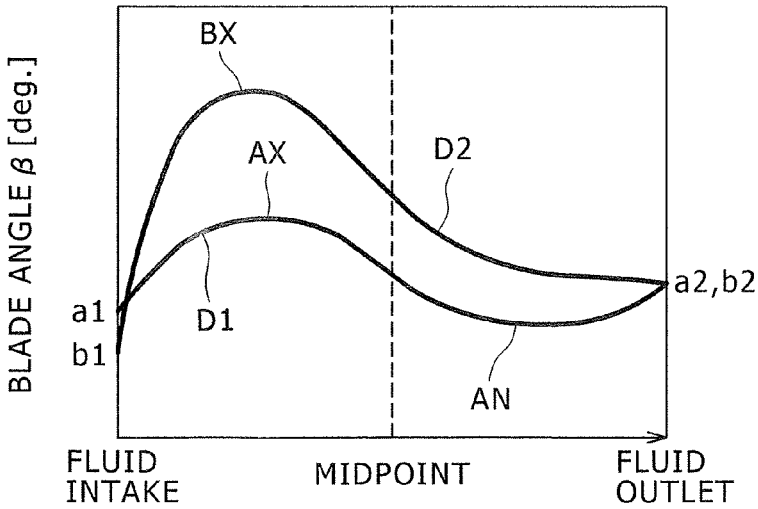
FIG. 1B is a view illustrating blade angle distribution of an impeller of the centrifugal compressor according to the first embodiment of the invention.
Figure 2:
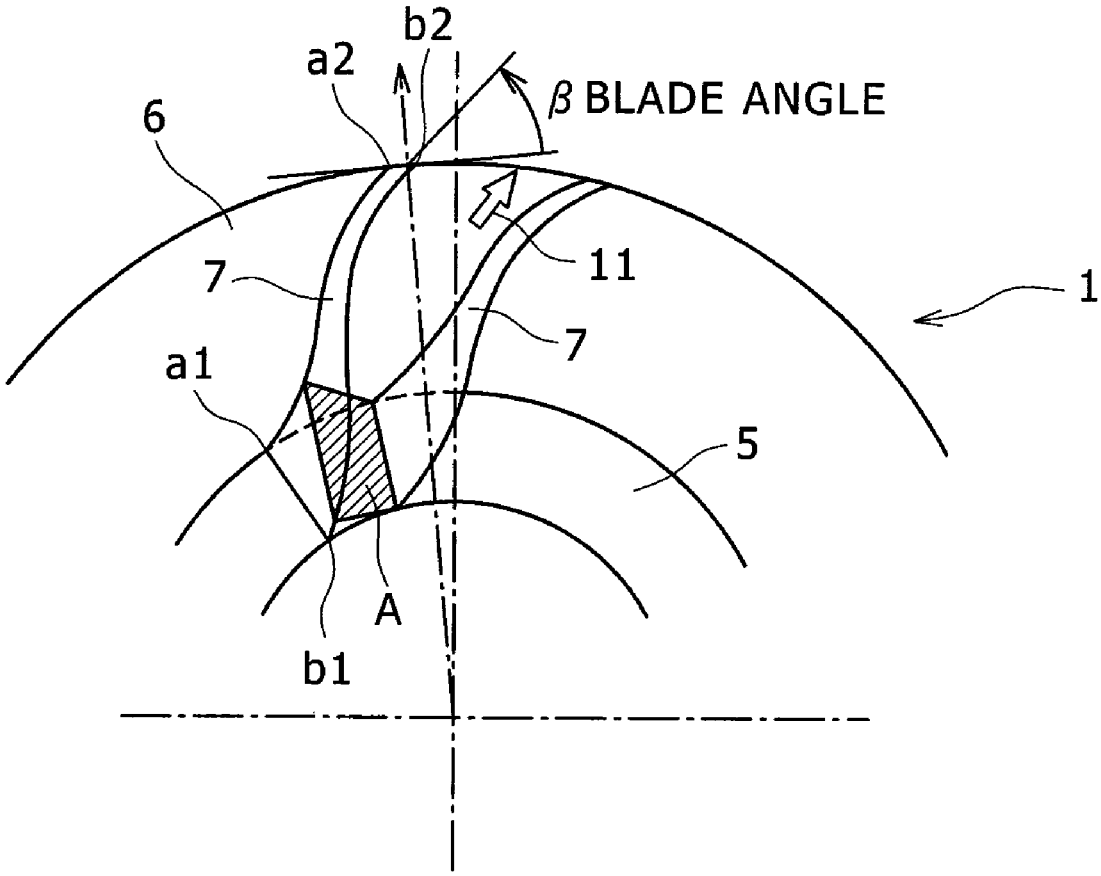
FIG. 2 is a view illustrating the definition of blade angle distribution of each portion of the blade of the impeller.

A first embodiment of the invention is described hereafter in detail with reference to the accompanying drawings. FIG. 1A is a cross-sectional view illustrating the configuration of a centrifugal compressor according to this embodiment. FIG. 1B is a view illustrating a blade angle distribution attached to the impeller shown in FIG. 1A. FIG. 2 is a view illustrating the definition of the blade angle distribution for each portion of the blade of the impeller.

As shown in FIG. 1A, the centrifugal compressor 100 according to the first embodiment includes an impeller 1, a diffuser 2, a return channel 3, and a return vane 4, which are sequentially disposed from the upstream (the left side of FIG. 1A) to the downstream.

The components and operation according to flow of working fluid 11 are described below.

The working fluid 11 is sucked into the centrifugal compressor 100 by the rotation of the impeller 1 and passes through a flow channel A formed between plural blades 7 that radially protrude from a circular plate 6 of the impeller 1 (refer to FIG. 2). Further, the working fluid 11 is increased in pressure by a centrifugal force while flowing toward the diffuser 2. Therefore, static pressure is recovered by reducing the fluid velocity while the working fluid passes through the diffuser 2. Thereafter, the working fluid passes through the return channel 3 and is then discharged through the return vane 4.

In this configuration, it is possible to attach the plural blades that form the flow channels for the working fluid 11 to the diffuser 2. Accordingly, recovery to the static pressure of the working fluid 11 is further promoted and fluid velocity of the working fluid flowing to the return channel 3 is reduced, such that loss at the return channel 3 can be reduced and efficiency is improved.

Further, a shroud 8, which is coaxially disposed with the rotary shaft 5 and covers the entire front side a1 to a2 of the blade 7, is supported by the blade 7, but is not necessarily required because the strength may not be allowable, depending on specifications of design of the blade. The working fluid 11 that passed through the return vane 4 flows to a latter stage centrifugal compressor, for a multistage centrifugal compressor, or to a scroll or a collector (not shown).

The impeller 1 shown in FIG. 1A includes the rotary shaft 5, a circular plate 6 integrally attached to the rotary shaft 5, and the plural blades 7 radially protruding from the circular plate 6. The blade 7 forms predetermined blade angle distribution from the inlet to the outlet of the working fluid 11.

Further, the blade angle distribution is obtained by distribution of angle β (blade angle) made by the blade 7 shown in FIG. 2 and a tangent line of the impeller 1, from the upstream of the blade 7 (longitudinal front direction) to the downstream (centrifugal direction). Further, the shroud 8 is not shown in FIG. 2.

FIG. 1B illustrates the blade angle distribution of the impeller 1 shown in FIG. 1A. When the blade angle β of the shroud side facing the circular plate 6 of the blade 7 is a first angle D1 and the blade angle β of the hub side of the circular plate 6 is a second angle D2, the outline of the front side a1 to a2 (shroud side) of the blade 7 from the upstream to the downstream of the working fluid 11 has a convex curve-shaped blade angle distribution where the first angle D1 has a local maximum point AX between a midpoint and the upstream, and has a concave curve-shaped blade angle distribution where the first angle has a local minimum point AN between the midpoint and the downstream. Further, the outline of the hub side b1 to b2 of the blade 7 (hub side) has a convex curve-shaped blade angle distribution where the second angle D2 has a local maximum point BX at the upstream from the midpoint. Further, the blade angle β at the midpoint does not define the relationship with the outlet blade angle and may not be more than the outlet blade angle.

According to the first embodiment, the outlines of the front side a1 to a2 of the blade 7 (shroud side) and the outline of the hub side b1 to b2 of the blade 7 (hub side) having the blade angle distributions, shown in FIG. 1*b*, form a substantially S-shaped line, as shown in FIG. 2.

The blade geometry as described above forms the outline of the front side a1 to a2 of the blade 7 (shroud side) and the outline of the hub side b1 to b2 of the blade (hub side) by combining the curved outlines in a straight line or a curved line in which the blade angle distributions change from the substantially middle portion of the blade. Further, the blade geometry has plural blade angle defining positions from the inlet to the outlet between the front side and the hub side, such that the difference between the blade angle β and a flow angle is reduced and the fluid velocity becomes uniform.

In FIG. 2, the area of the flow channel becomes the maximum when the blade angle β is 90°, that is, the blade is positioned in the exact radial direction. That is, the curved blade angle distribution having the local maximum point increases the area of the flow channel and promotes deceleration flow. On the other hand, the curved blade angle distribution having the local minimum point decreases the area of the flow channel and promotes acceleration flow. Therefore, describing the flow inside the impeller 1 having the blade angle distribution shown in FIG. 1B, the deceleration flow is promoted at the front portion of the flow channel from the upstream to the midpoint by the curved blade angle distribution having the local maximum point, and the acceleration flow is promoted at the rear portion of the flow channel from the midpoint to the downstream by the curved blade angle distribution having the local minimum point.

The centrifugal compressor shown in FIG. 2 has the inlet of the flow channel disposed at the center in the radial direction of the circular plate 6 and the outlet of the flow channel disposed at the outside of the radial direction. Because of the differences in the radial positions, the distance between the blades 7 is larger at the outlet than the inlet of the flow channel. Therefore, the area of the flow channel is smaller at the inlet than the outlet while a throat where the area of the flow channel is the minimum is formed adjacent to the inlet. Accordingly, it is required to make the blade angle β close to 90° to promote the deceleration flow at the inlet by increasing the area of a portion of the inlet where the area of the flow channel is primarily small, in which it is preferable that the blade angle distribution at the front half region of the flow channel has a curved shape with a maximum local point. Further, it is required to make the blade angle β close to 0° to promote the acceleration flow by decreasing the area of a portion adjacent to the outlet where the area of the flow channel is primarily large, in which it is preferable that the blade angle distribution at the rear half region of the flow channel has a curved shape with a local minimum point.

The cross-sectional area of the flow channel A formed between the blades 7 is designed to be appropriate to design flow rate, such that the area is too large with respect to the flow rate when a small flow rate side than the design flow rate is operated. In this case, the flow rate at the hub side of the blade 7 disposed at the circular plate 6 is relatively increased by pumping due to a centrifugal force of the circular plate 6, such that the ratio of the fluid that is discharged through the hub side and the outlet increases more than the design flow rate. That is, the main stream of the working fluid 11 is biased to the hub side of the blade 7.

When the small flow rate side is operated, the flow rate relatively increases at the hub side of the blade 7 and the flow rate at the front side relatively decreases, in which it is effective to promote the acceleration flow by decreasing the area of the portion adjacent to the outlet of the front side of the blade 7 in order to prevent surge from being generated. Therefore, according to this embodiment, the curved shape with the local minimum point is given to the blade angle distribution at the rear half region of the flow channel at the front side a1 to a2 of the blade 7, in consideration of decreasing the area of the flow channel. Further, the blade angle distribution of the centrifugal compressor according to this embodiment has a breakpoint between a region where the area of the flow channel adjacent to the inlet is increased and a region where the area of the flow channel adjacent to the outlet is decreased.

In the region within the operating range of the small flow rate side, the cross section of the flow channel A formed between the blades 7 is too large for the flow rate, such that the main stream of the working fluid 11 is biased to the hub side of the blade 7. In the blade angle distribution according to this embodiment, the cross section of the flow channel is decreased by the curved distribution having the local minimum point from the midpoint of the front side a1 to a2 of the blade 7 to the downstream. Accordingly, the main stream is acceleration flow at the rear half of the flow channel, such that the working fluid 11 can easily and smoothly pass through the impeller 1. As a result, because a point where the flow separation, which is a cause of surge, starts is moved to less flow rate side, surge is prevented from being generated in the impeller 1 having the blade angle distribution of this embodiment, as compared with impellers in the related art.

On the other hand, in a region within an operating range of a large flow rate side, the area of the flow channel A formed between the blades 7 is too small for the flow rate, such that the main stream increases in flow velocity with increase in suction flow rate and, as a result, a region where the flow velocity is more than the sonic velocity (Mach number 1), is generated. When flow velocity at a side of the cross section of the flow channel A is Mach number 1, choke is generated. Further, the portion of the side of the cross section of the flow channel A where the flow velocity is Mach number 1 is mainly the throat cross section of the throat where the flow channel width formed at the front half of the flow channel A is the minimum.

However, in the blade angle distribution according to this embodiment, since the blade 7 is in the radial direction by the curved distribution having the local maximum point from the upstream to the midpoint of the front side a1 to a2 and the hub side b1 to b2 of the blade 7, the area of the throat formed at the front half of the flow channel increases. As a result, because the choke point is moved to a larger flow rate side, the choke is prevented from being generated in the impeller 1 having the blade angle distribution of this embodiment, as compared with impellers in the related art.

Figure 3:
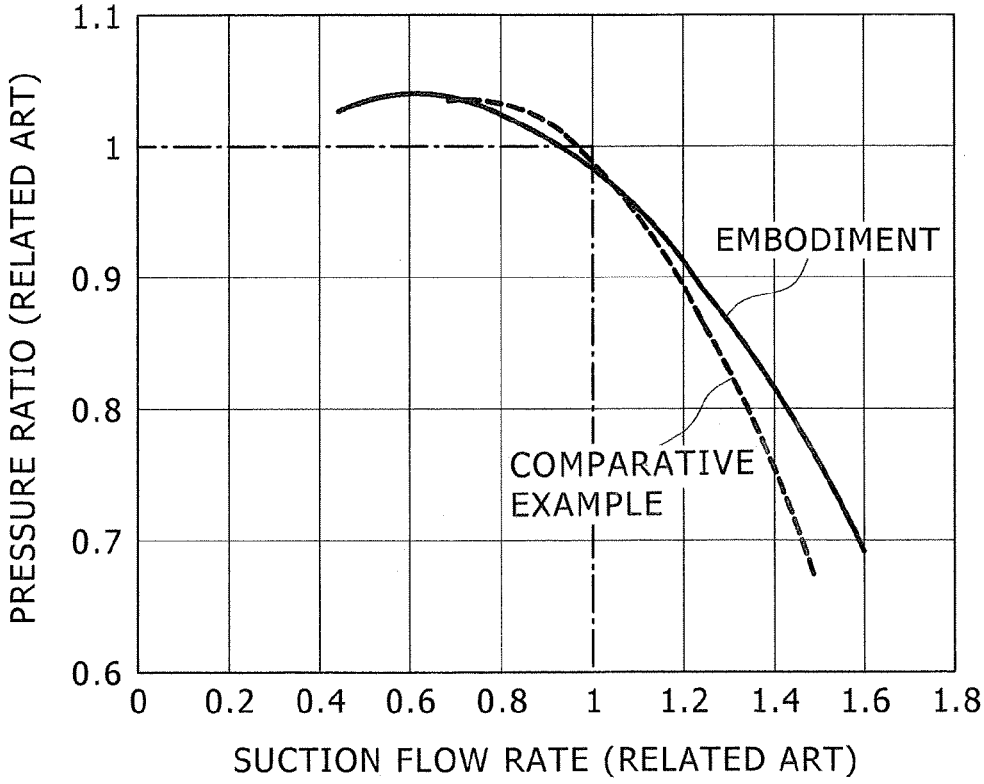
FIG. 3 is a view showing a comparing result of the operating regions of an example according to the first embodiment of the invention and a comparative example according to the related art.
Figure 4:
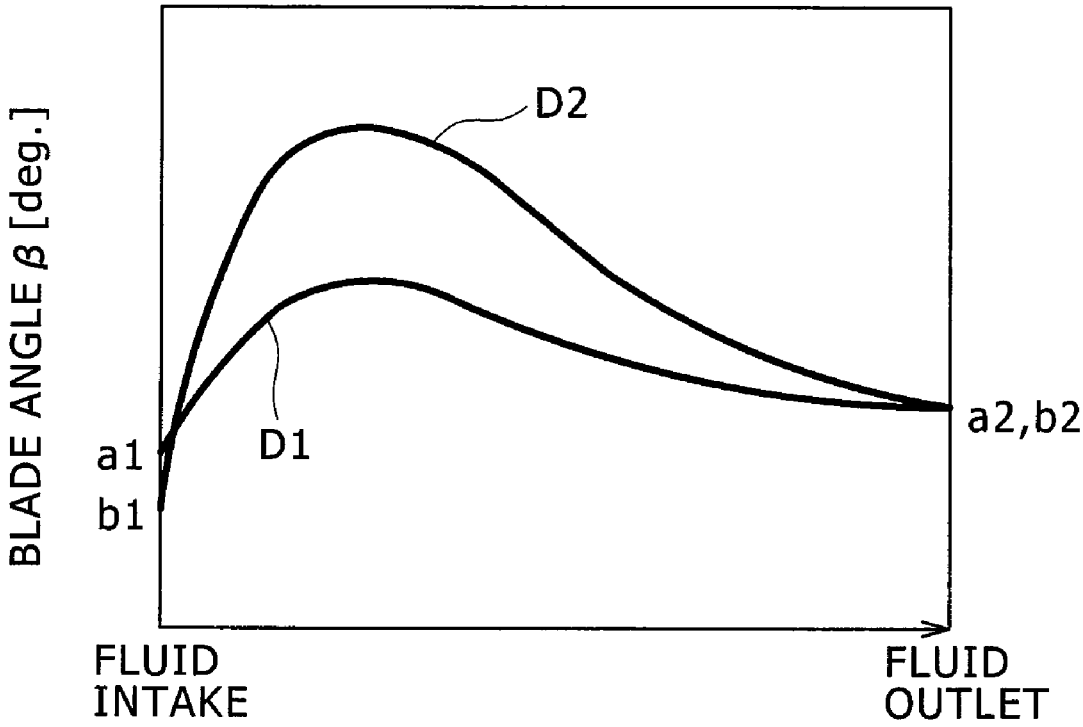
FIG. 4 is a view illustrating blade angle distribution of an impeller of a centrifugal compressor according to the related art.

A numerical analysis result of an example according to this embodiment and a comparative example according to the related art is described. FIG. 3 shows a result of numerical fluid analysis that compares operating regions while the suction temperatures and pressures are kept the same. The example is the centrifugal compressor 100 equipped with the impeller 1 having the blade angle distribution (see FIG. 1B) according to this embodiment and the comparative example is a centrifugal compressor equipped with an impeller having the blade angle distribution according to the related art shown in FIG. 4. Main specifications, such as the diameter, an inlet blade angle, and an outlet blade angle, are the same in the example and the comparative example. The numerical fluid analysis is applied to configurations of the impeller and a diffuser without an impeller.

In FIG. 3, the suction flow rate standardized by the design flow rate is shown on the transverse axis and pressure ratio standardized by the design pressure ratio in the related art is shown on the vertical axis. When the limit of the operating region of the small flow rate side is a surged flow rate and the limit of the operating region of the large flow rate side is a choked flow rate, as shown in FIG. 3, the example to which the blade angle distribution (see FIG. 1B) according to this embodiment is applied has operating ranges of about 20% increase at the small flow rate side and about 10% increase at the large flow rate side, as compared with the comparative example. That is, the centrifugal compressor 100 equipped with the impeller having the blade angle distribution according to this embodiment achieves a relatively large operating range as compared with the related art.

Second Embodiment

Figure 5A:
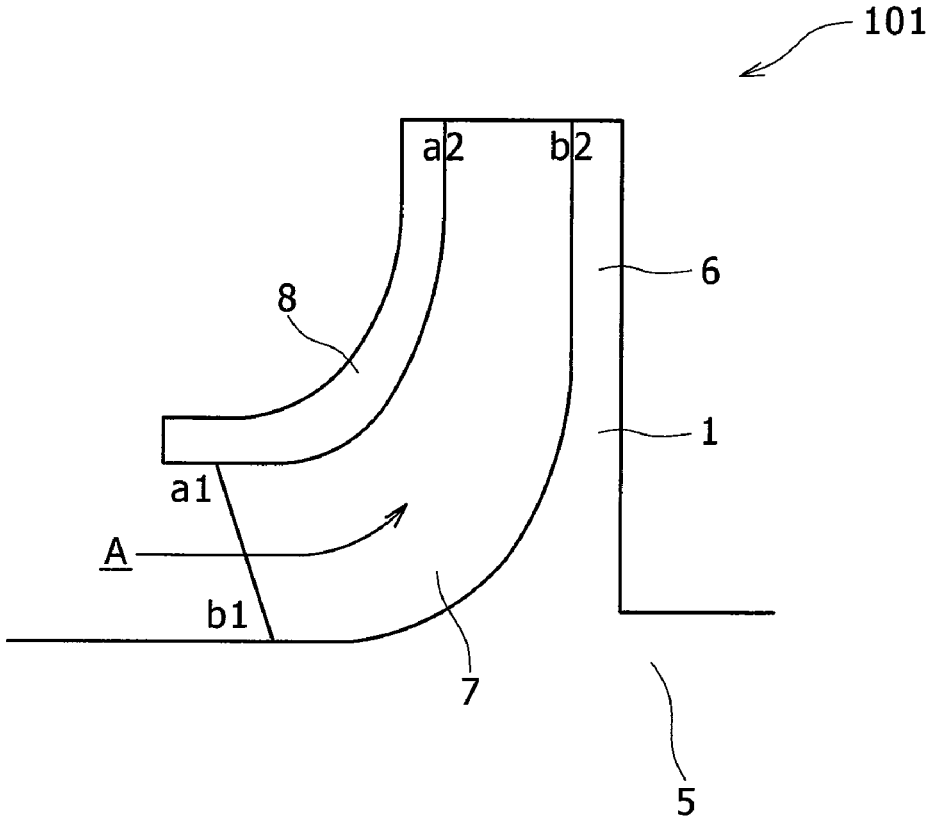
FIGS. 5A and 5B are views illustrating definition of a rake angle of an impeller.
Figure 5B:
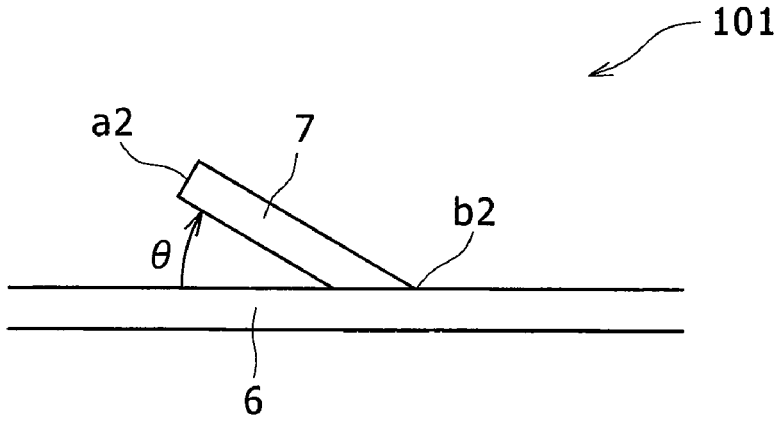

Next, a second embodiment of a centrifugal compressor according to the invention is described hereafter. The same components as the first embodiment (see FIG. 1) are not described in a centrifugal compressor 101 according to this embodiment and other components different from the first embodiment are described in priority. FIG. 5A is a diagram illustrating a rake angle that is made by a straight line connecting the blade front end a2 of a fluid outlet a2 to b2 with the hub side b2 and the circumference of the circular plate 6 that is perpendicular to the center of the rotary shaft 5. FIG. 5B shows the blade of the outlet seen from the fluid outlet a2 to b2 to the rotary shaft 5 and the rake angle is the angle θ of the blade.

A blade angle distribution of an impeller according to this embodiment is described. In this embodiment, as in the first embodiment, the outline of the front side a1 to a2 (shroud side) of the blade 7 from the upstream to the downstream of the blade 7 has a convex curve-shaped blade angle distribution where the first angle D1 has a local maximum point between a midpoint and the upstream, and has a concave curve-shaped blade angle distribution where the first angle D1 has a local minimum point between the midpoint and the downstream. Further, the outline of the hub side b1 to b2 of the blade 7 (hub side) has a convex curve-shaped blade angle distribution where the second angle D2 has a local maximum point at the upstream from the midpoint.

In addition to the technical characteristics of the first embodiment, the rake angle θ is in the range of 60° to 90°.

Since the rake angle is in the range of 60° to 90°, it is possible to prevent deformation of the blade 7 that is generated when the blade 7 is welded to the circular plate 6 or the shroud 8, while the shape of bead on the welding surface is easily maintained in an arch shape in which stress concentration does not practically occur.

Third Embodiment

Figure 6:
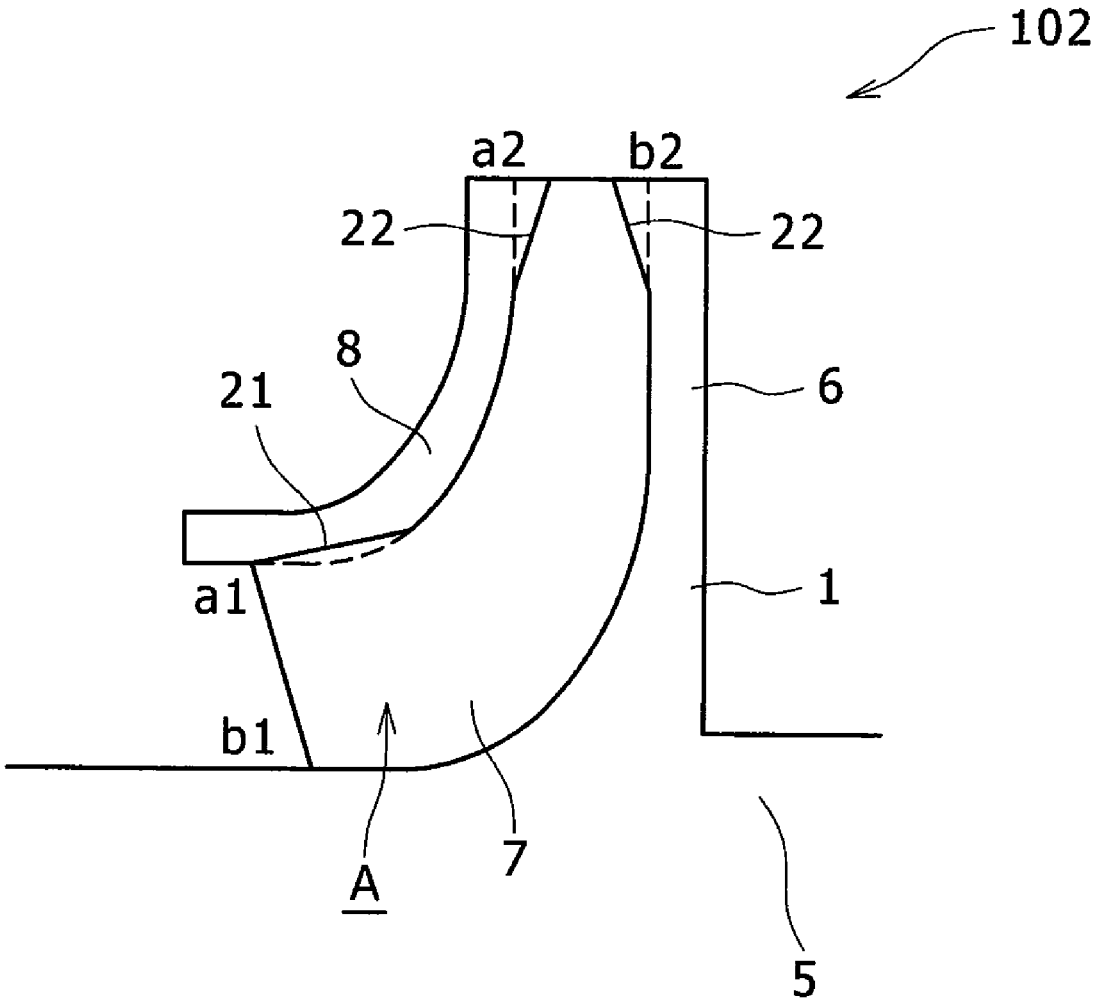
FIG. 6 is a view showing a vertical cross section of a centrifugal compressor according to an embodiment of the invention.

Next, a third embodiment of a centrifugal compressor according to the invention is described. In a centrifugal compressor 102 according to this embodiment, the same components as the first embodiment (see FIG. 1) or the second embodiment are not described and other components different from the first embodiment are described in priority. FIG. 6 shows a vertical cross-section of this embodiment.

A blade angle distribution of an impeller according to this embodiment is described. In this embodiment, as in the first embodiment, the outline of the front side a1 to a2 (shroud side) of the blade 7 from the inlet to the outlet of the working fluid 11 has a convex curve-shaped blade angle distribution where the first angle D1 has a local maximum point between a midpoint and the upstream, and has a concave curve-shaped blade angle distribution where the first angle D1 has a local minimum point between the midpoint and the downstream. Further, the outline of the hub side b1 to b2 of the blade 7 (hub side) has a convex curve-shaped blade angle distribution where the second angle D2 has a local maximum point at the upstream from the midpoint.

In addition to the technical characteristics of the first embodiment, the flow channel A adjacent to the fluid intake is enlarged by forming the shroud side in a conical shape with a predetermined tapered angle in the axial direction with respect to the rotary shaft, while the flow channel A adjacent to the fluid outlet at the front side or adjacent to the fluid outlet at the hub side, which is a side of the circular plate, is narrowed by forming the hub side in a conical shape with a predetermined tapered angle in the centrifugal direction.

In this embodiment, as shown in FIG. 6, a tapered angle is provided to the front half portion of the front side a1 to a2 of the blade 7 in the vertical cross section with respect to the rotary shaft 5 and a flow channel enlargement portion 21 that enlarges the flow channel in the radial direction is provided. Further, a large curvature is provided to the front half portion of the hub side b1 to b2 of the blade 7 to enlarge the flow channel. By providing the configuration as described above, according to the shape of the flow channel according to this embodiment, it is possible to decelerate the working fluid 11 at the front half portion of the flow channel from the upstream to the midpoint.

Further, according to this embodiment, the flow channel A has a flow channel narrowing portion 22 through the outlet by providing a tapered angle with respect to the radial direction to the rear half portion of the front side a1 to a2 and the hub side b1 to b2 of the blade 7 in the vertical cross section. By providing the configuration as describe above, according to the shape of the flow channel A according to this embodiment, it is possible to accelerate the working fluid 11 at the rear half portion from the midpoint to the downstream of the flow channel.

The tapered angle with respect to the radial direction may be formed at any one of the rear front portions of the front side a1 to a2 and the hub side b1 to b2 of the blade 7. When the tapered angle is formed at any one as described above, it is possible to obtain the acceleration effect at the rear half of the flow channel. In this configuration, the tapered portions of the hub side b1 to b2 and the front side a1 to a2 having the tapered angle provided to the inlet and the outlet, although shown as a straight line in FIG. 6, are preferably formed in smooth curves to prevent resistance.

In this embodiment, since the deceleration at the front half portion and the acceleration at the rear half portion in the blade angle distribution is controlled by adjusting the vertical cross section, it is possible to prevent peaks of the local maximum point and the local minimum point of the blade angle distribution and prevent changes in load due to rapid changes in the angle.

Further, even though the blade angle distribution that is a common technical characteristic with the first embodiment is impossible by the changes in load due to the rapid changes in angle, according to the configuration having the vertical cross section of this embodiment as shown in FIG. 6, it is possible to decelerate the working fluid 11 at the front half portion and accelerate the working fluid 11 at the rear half portion.

Further, in this embodiment, it is also possible to maintain the rake angle θ between 60° to 90°, as shown in FIG. 5 showing the configuration according to the second embodiment.

Fourth Embodiment

Figure 7:
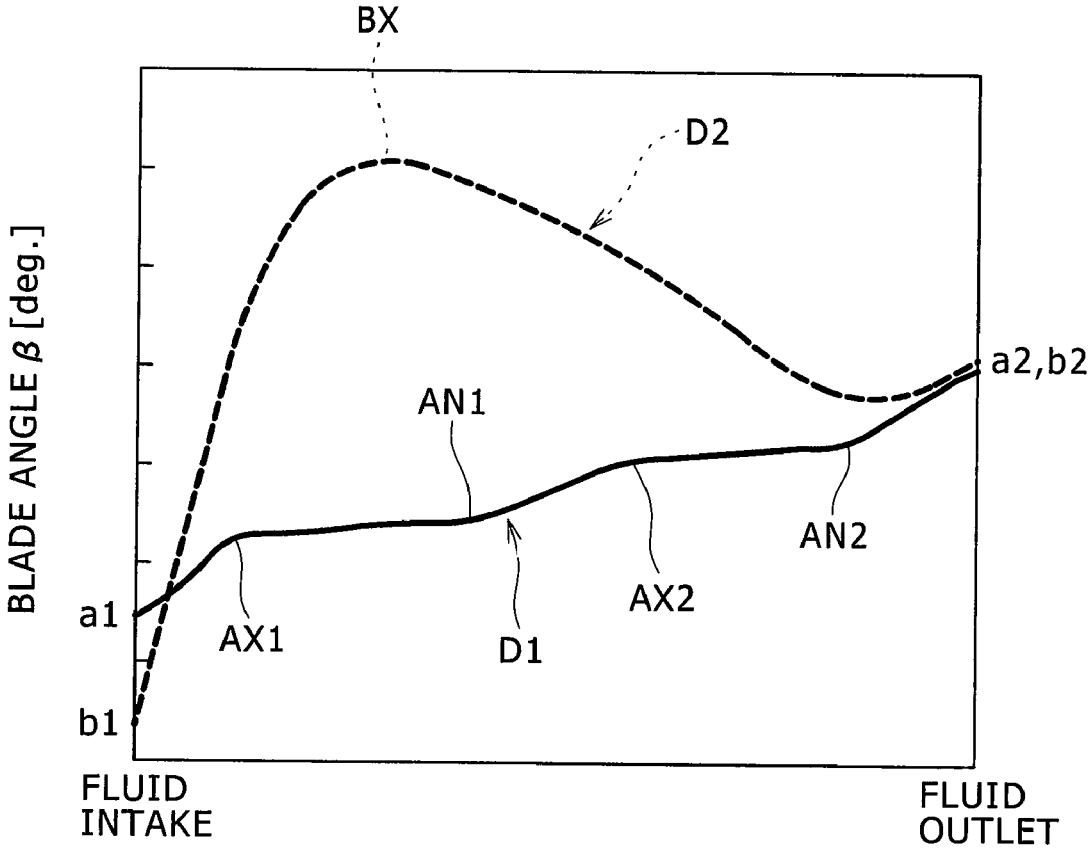
FIG. 7 is a view illustrating blade angle distribution of an impeller of a centrifugal compressor according to a fourth embodiment of the invention.

Next, a fourth embodiment of a centrifugal compressor according to the invention is described. FIG. 7 illustrates a blade angle distribution of the impeller 1 shown in FIG. 1A.

The blade angle distribution of the impeller according to this embodiment is described. Different from the first embodiment, according to this embodiment, in the outline of the front side a1 to a2 (shroud side) of the blade 7 from the fluid intake to the fluid outlet of the working fluid 11, the first angle D1 has plural a convex-shape curved lines of angle distribution having local maximum points and concave-shape curved lines of angle distribution having local minimum points, which alternately appear. In the example shown in FIG. 7, a local maximum point, a local minimum point, a local maximum point, a local minimum point, that is, two local maximum points and two local minimum points, total four local maximum and minimum points alternatively appear. Further, the outline of the hub side b1 to b2 of the blade 7 (hub side), as in the first embodiment, has convex curve-shaped blade angle distribution where the second angle D2 has a local maximum point at the upstream from the midpoint.

Specifications of the centrifugal compressor is required to be adjusted in designing, depending on the type of working fluid that is sucked (physical characteristics), flow velocity (flow rate), conditions including temperature, changes of peripheral devices, such as whether the diffuser vane is provide or the shroud is provided, and required operational conditions. For example, development of a boundary layer depends on the viscosity of the working fluid 11 (see FIGS. 1A and 1B). When the boundary layer develops, the main stream of the working fluid goes away from the wall of the flow channel and flow separation starts. Accordingly, when the working fluid has high viscosity and easily develops a boundary layer, excessive deceleration of the flow causes flow separation and may cause loss.

In the centrifugal compressor of the first embodiment, a choke margin is enlarged to increase the cross-sectional area of the flow channel at the front half. However, since development of the boundary layer, which should be prevented, depends on the viscosity of the working fluid, excessive deceleration of flow may be possible, depending on the conditions, such as the type of working fluid. In this case, as in this embodiment, it is possible to prevent a local boundary layer from developing by forming the shroud side in a curve shape in which the first angle D1 has an angle distribution of the local maximum points and an angle distribution of the local minimum points from the front area of the shaft direction to the center direction to appropriately apply acceleration flow to deceleration flow of the working fluid.

Further, in this embodiment, it is also possible to maintain the rake angle θ, which is shown in FIG. 5 according to the second embodiment, in the range of 60° to 90°.

Next, another embodiment of the invention is described. A turbo-typed fluid machine may be equipped with a centrifugal impeller or an oblique flow impeller. A turbo compressor, one type of the turbo-typed fluid machine, is a device that increases pressure of the working fluid and used in various plants. Recently, it is required to reduce driving energy the compressor due to problems relating to energy and environment, such that it is required to at least improve efficiency of the impeller of the turbo compressor to reduce power for the compressor.

A hydraulic centrifugal compressor, one of the turbo compressors, increases pressure of fluid by moving outward a centrifugal force field generated by rotation of the impeller, unlike to increasing the pressure of the fluid by a rotor vane or a static vane as in an axial compressor. That is, the increase of pressure in the hydraulic centrifugal compressor is achieved by changes in potential energy of the fluid in the centrifugal force field of a rotor. Therefore, the hydraulic centrifugal compressor is not limited in a process of increasing pressure by development or separation of a boundary layer in an inverse draft. Accordingly, in a hydraulic centrifugal compressor according to the related art, unlike the axial compressor, it was considered that the blade geometry, particularly the cross section of the rear edge that is an outlet of working fluid provided in the center direction does not practically affect the performance. Therefore, the cross section of the rear edge was generally used as itself without additional machining of forming the rear edge into an arc shape after completing the outer circumference by form rolling on a lathe.

Efficiency of the impeller of the turbo compressor can be improved by decelerating flow of working fluid using a diffuser disposed at the downstream of the impeller. The diffuser is classified into a vaneless diffuser and a vane diffuser, and the vane diffuser is used to improve efficiency.

Since the working fluid is discharged from the impeller that rotates, the rear stream is periodically fluctuated. Further, the fluctuating flow is transmitted to the diffuser. The frequency of the fluctuating flow is the same as a value obtained by multiplying vane-passing frequency, i.e. the number of blades by rotating frequency. Therefore, as compared with the vaneless diffuser, the vane diffuser has a problem in that a large noise is generated at the vane-passing frequency. Accordingly, it is required to dispose the downstream of the impeller after a radial position such that the downstream fits to the front edge of the diffuser vane to reduce the noise. Further, it is preferable that a radius ratio of the front edge of the diffuser vane and the outlet of the impeller is large, to achieve the above configuration.

On the other hand, the diffuser vane makes it easy to reverse the flow adjacent to the wall toward the outlet of the impeller by rapidly increasing the pressure gradient in the radial direction from the outlet of the impeller of the fluid adjacent to the wall. Since the reverse flow causes rotating stall that limits the operating region by an excitation force of the fluid, such that it is preferable the radius ratio of the front edge of the diffuser vane and the outlet of the impeller is small to prevent the rotating stall.

As described above, in the radial position of the front edge of the diffuser vane, the reduction of noise is contrary to the prevention of rotating stall, such that it is difficult to simultaneously solve both problems.

In the following embodiments, the blade geometry attached to an impeller of a turbo compressor that solves the above problems is provided.

In detail, a turbo compressor includes a rotary shaft, a circular plate supported by the rotary shaft, plural blades substantially radially disposed and protruding from the circular plate, and has flow channels formed between the blades, in order to suck fluid from the front area in the shaft direction by rotating the circular plate with the rotary shaft and discharge the fluid, which increases in pressure while passing through the flow channels, in a predetermined changed direction, in which the width of the blade is gradually reduced from the end of the fluid discharging side to the downstream.

According to the above configuration, it is possible to reduce a flow separation area in the rear stream.

According to the blade geometry of the turbo compressor, it is possible to solve the above problems, reduce noise, and prevent rotating stall.

Fifth Embodiment

Hereafter, a fifth embodiment of the invention is described with reference to the accompanying drawings.

Figure 8A:
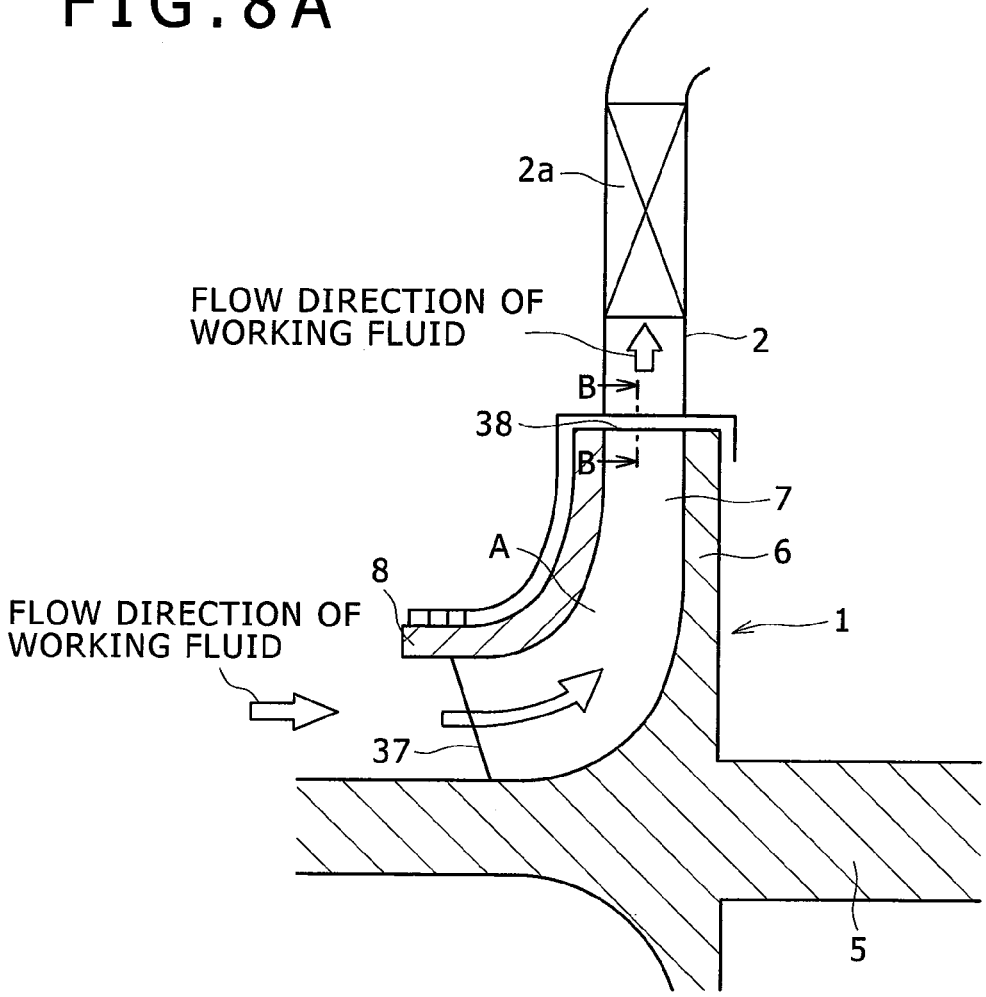
FIGS. 8A and 8B are views illustrating the basic configuration of a turbo compressor.
Figure 8B:
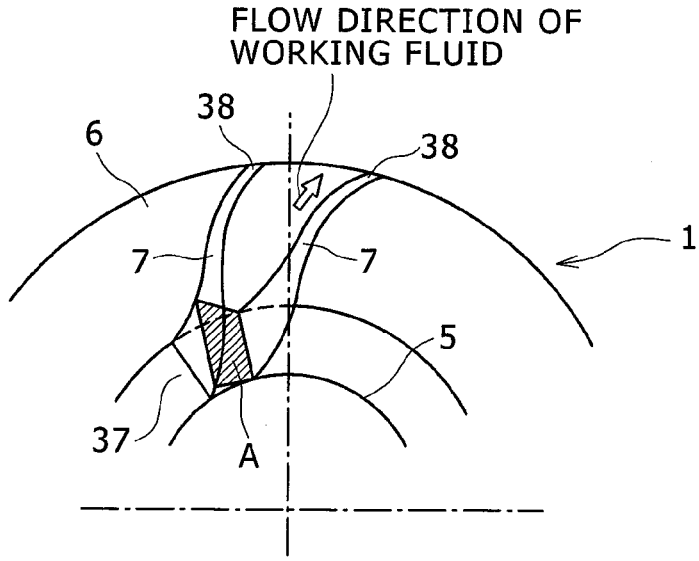

FIG. 8A is a side view illustrating the basic configuration of a turbo compressor and FIG. 8B is an enlarged view showing a portion of an impeller that is describe below, seen in the axial direction of the compressor. The turbo compressor of the fifth embodiment, as shown in FIG. 8A, includes an impeller 1 and a diffuser 2. The impeller 1 includes a rotary shaft 5, a head-cut cone-shaped circular plate 6 supported by the rotary shaft 5, plural blades 7 substantially radially disposed and protruding from the circular plate 6 (see FIG. 8B), and a shroud 8 disposed on the outer side of the blade 7. As shown in FIG. 8B, a flow channel A is formed between the blades 7, and as the circular plate 6 rotates with the rotary shaft 5, fluid is sucked from the front area in the shaft direction. Thereafter, the fluid changes the flow direction while increasing in pressure through the flow channel A and then discharged. The fluid discharged from the impeller 1 flows to the diffuser 2. Further, the shroud 8 may not be provided.

Hereinafter, it is assumed that, in the flat portion of the blade 7, the edge in the inflow direction of the working fluid is a front edge 37 (the end of the fluid inflow side) and the edge in the outflow direction is a rear edge 38 (the end of the fluid discharging side). Further, diffuser 2 is classified into a vane diffuser having a diffuser vane 2*a* and a vaneless diffuser without the diffuser vane 2*a*, but it is also assumed that, in the diffuser vane 2*a* of the vane diffuser, the edge of the diffuser vane 2*a* in the inflow direction of the working fluid is a front edge and the edge in the outflow direction is a rear edge.

The fluid is first locally rapidly accelerated adjacent to the front edge 37 of the blade 7 and then rapidly decelerated.

At the rear edge 38 of the blade 7, a downstream region where flow velocity is small exists at the downstream. The downstream is accompanied with a separation region according to the shape and thickness of the rear edge 38 and operating condition of the impeller 1. When the separation region is large, mixing-loss becomes large at the downstream and a long distance is required for uniform flow.

Figure 9:
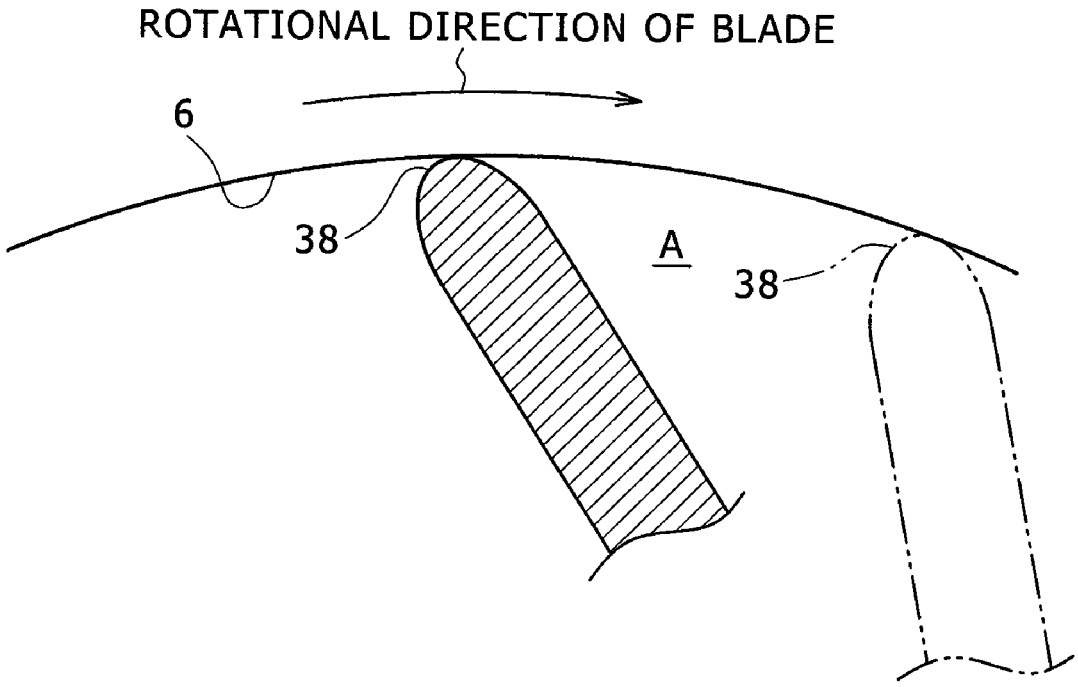
FIG. 9 is a view illustrating an impeller according to a fifth embodiment and the cross section of the rear edge of the impeller.

FIG. 9 is a view showing an embodiment of the impeller according to the fifth embodiment, of which the rear edge has an elliptical cross section. The impeller shown in FIG. 9 is seen from the front area in the shaft direction of the blade 7, in the cross section taken along the line B-B of the rear edge 38 shown in FIG. 8A. The width of the blade 7 is gradually reduced from the end of the fluid discharging side of the flow channel A toward the downstream, in detail, the blade 7 is formed in a cylinder having a semi-elliptical cross section with the long axis arranged in the direction of the flow channel A and the short axis arranged in the width direction of the blade.

It is preferable in the elliptical shape according to this embodiment that the ratio of the short axis in the thickness direction of the blade and the long axis in the flow direction is about 1 to 2. However, even though the ratio of the short axis and the long axis is increased by 1 to 4, efficiency is not largely improved. Further, in manufacturing the impeller 1, when the shroud 8 is joined with the blade 7 by welding or diffusion bonding, deformation at the joint of the circular plate 6 of the rear edge 38 or the shroud 8 with blade 7 may be increased by heat stress due to the welding heat, such that it is not preferable to make the shape of the rear edge 38 very slim to prevent the deformation.

Figure 10A:
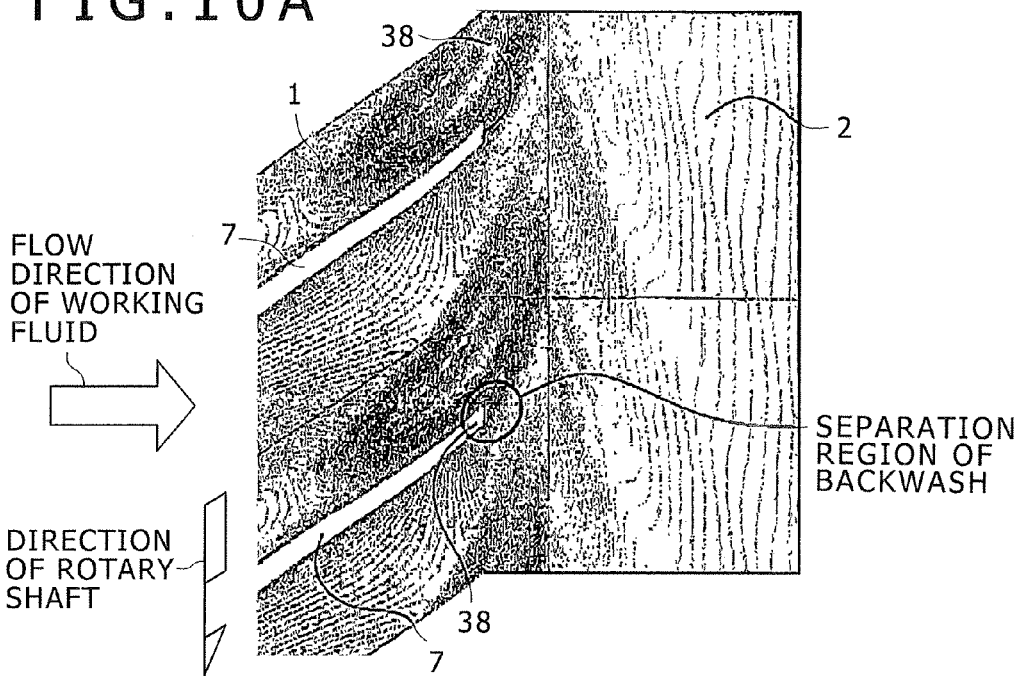
FIGS. 10A and 10B are views illustrating a flow analysis result for cross sections of two types of rear edges.
Figure 10B:
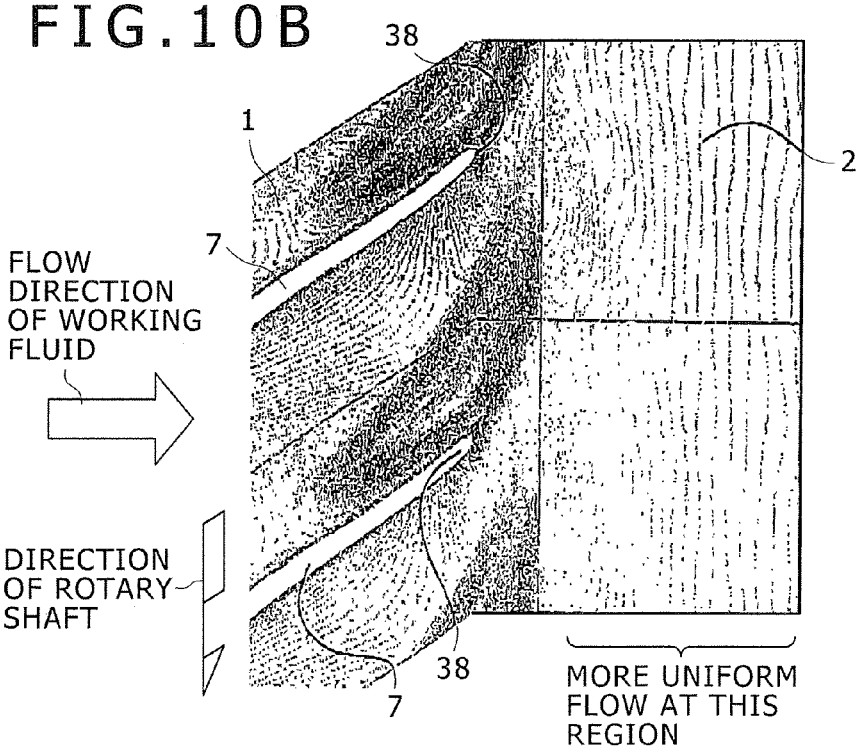

FIGS. 10A and 10B are views illustrating a result of flow analysis (the same Mach number analysis of a flow field) of an example according to this embodiment and a comparative example according to the related art, in which FIG. 10A shows the comparative example and the FIG. 10B shows the example according to this embodiment. Further, only the portion adjacent to the rear edge 38 of the blade 7 is shown in FIGS. 10A and 10B, but the analysis is actually applied to the entire region of the impeller 1 and the diffuser 2, and FIGS. 10A and 10B show corresponding portions that are enlarged. The affect by the diffuser vane 2*a* is excluded in both the comparative example and the example according to this embodiment, and in order to compare degree of uniformity of the downstream of the impeller 1, a vaneless diffuser that is not provided with the diffuser vane 2*a* is analyzed.

As seen from FIGS. 10A and 10B, comparing the example according to this embodiment and the comparative example, the thickness of the dark portion of the rear end gradually decreases, which shows that gaps between the same Mach number lines are narrow in the analysis result and returning to the surrounding flow is fast. Further, as compared with the comparative example, in the example according to this embodiment, the gaps of the same Mach number lines are uniform in the downstream of the impeller 1, i.e. the region of the diffuser 2. Therefore, it can be seen that the separation region of the rear edge shape at the rear stream is smaller in the example according to this embodiment than the comparative example, that is, the flow becomes uniform at the downstream of the impeller 1, i.e. the region of the diffuser 2.

As described above, when the cross section of the read edge 38 is formed in a smooth shape, such as an elliptical arc or an arc shape, it is possible to reduce the separation region of the rear stream. Accordingly, the mixing-loss is reduced and the efficiency of the impeller 1 is improved. Further, interference of the diffuser vanes disposed at the downstream of the impeller 1 is reduced and noise is reduced. Further, since the rear stream of the impeller 1 becomes quickly uniform, it is possible to reduce the radial ratio of the front edge of the diffuser vane 2*a* and the outlet of the impeller 1 and prevent the rotating stall. As described above, this embodiment makes it possible to simultaneously reduce the noise and prevent the rotating stall.

The ratio of the long axis and the short axis in the elliptical cross section described above does not need to be exact and a manufacturing tolerance is allowable. Further, a single-stage centrifugal compressor is shown in FIGS. 8A and 8B, but it should be understood that the same operation can be achieved by a multi-stage compressor with plural compressors coaxially connected in a series or an oblique flow compressor.

Sixth Embodiment

Next, a sixth embodiment of a turbo compressor according to the invention is described.

Figure 11:
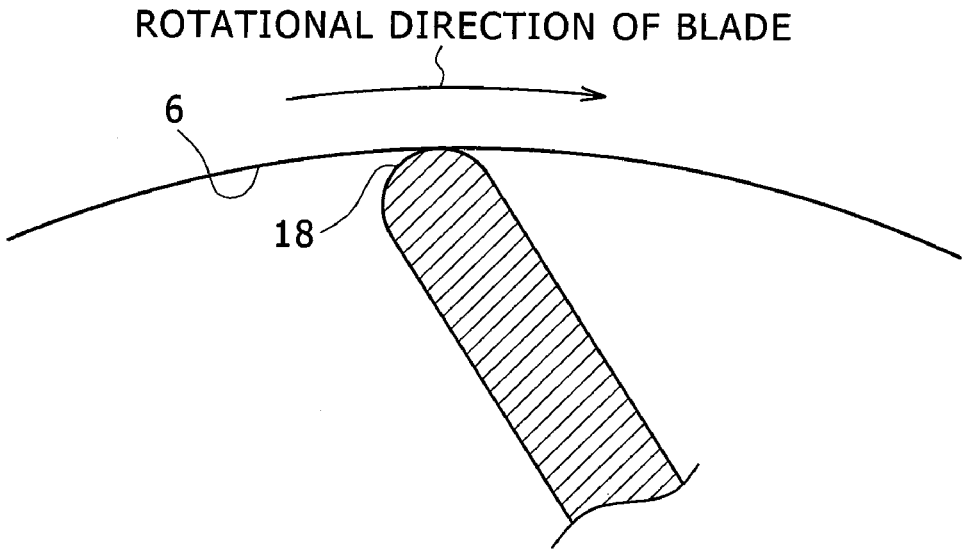
FIG. 11 is a view illustrating the cross section of the rear edge of an impeller according to a sixth embodiment.

FIG. 11 is a view illustrating the cross section of the rear edge of an impeller according to the sixth embodiment, taken along the line B-B of FIG. 8A.

The sixth embodiment is an example in which the cross section of the rear edge 18 of the impeller 1 is formed in a shape having a smooth curvature as in the fifth embodiment; however, unlike to the fifth embodiment, an arc shape (substantially semi-circular end) is applied. By forming the cross section of the rear edge 18 in the most simple arc shape having a curvature, it is possible to achieve substantially the same effect of improving efficiency, reducing noise, and preventing rotating stall, as the elliptical shape of the fifth embodiment.

Seventh Embodiment

Next, a seventh embodiment of a turbo compressor according to the invention is described.

Figure 12:
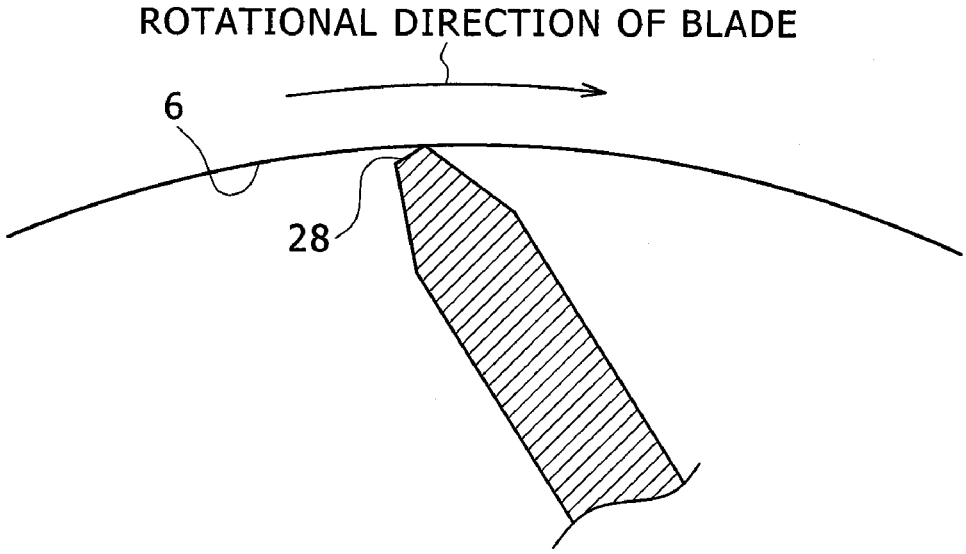
FIG. 12 is a view illustrating the cross section of the rear edge of an impeller according to a seventh embodiment.

FIG. 12 is a view illustrating the cross section of the rear edge of an impeller according to the seventh embodiment, taken along the line B-B of FIG. 8A.

In the cross section of the rear edge 28 of the impeller 1, the seventh embodiment is an example of forming an edge by gradually decreasing the thickness of the blade 7 at the rear edge 28, obtained by straightly cutting off the blade geometry in the related art. According to this shape, it is possible to achieve the same effect of improving efficiency, reducing noise, and preventing rotating stall, as the elliptical shape of the first embodiment.

Further, when the edge is obtained by straightly cutting off the blade geometry in the related art and a form rolling surface remains on the outer circumference, as shown in FIG. 12, it is possible to achieve an effect of improving efficiency, reducing noise, and preventing rotating stall, even by cutting off only one side, not straightly cutting off both sides of the blade 7. Further, it is possible to heighten the effect of improving efficiency, reducing noise, and preventing rotating stall, by applying fillet to the corners between the blade 7 and the rear edge 28 straightly cut off, and the form rolling surface of the outer circumference and the rear edge 28 straightly cut off to obtain a smooth shape.

Further, the cross section of the remaining rear edge 28 after being cut off may be any one of the arc shape according to the sixth embodiment and the straight shape according to the seventh embodiment. According to the above configuration, though there is slight difference in degree, but it is possible to achieve an effect of improving efficiency, reducing noise, and preventing rotating stall, as the elliptical shape according to the fifth embodiment.

Preferred embodiments of the invention were described above. The present invention is not limited to the embodiments, and can be modified without departing from the aspect of the invention.

What is claimed is:

1. A centrifugal compressor comprising a rotary shaft, a circular plate supported by the rotary shaft, and a plurality of blades substantially radially disposed and protruding from the circular plate, and having flow channels of a cross sectional area formed between the blades, in order to suck fluid from a front area in a shaft direction by rotating the circular plate with the rotary shaft and then discharge the fluid, which increases in pressure while passing through the flow channels, in a centrifugal direction, wherein, assuming that a blade angle of a shroud side of the blade is a first angle and a blade angle of a hub side disposed at the circular plate is a second angle, the shroud side is formed in a curved shape having a first angle distribution from the front area in the shaft direction toward the centrifugal direction in which the first angle distribution has a local maximum point at which the cross sectional area of the flow channel changes from expansion to reduction that is before a substantially middle portion and has a local minimum point after the substantially middle portion at which the cross sectional area of the flow channel changes from reduction to expansion, and the hub side is formed in a curved shape having a second angle distribution from the front area in the shaft direction toward the centrifugal direction in which the second angle distribution has a local maximum point at which the cross sectional area of the flow channel changes from expansion to reduction before the substantially middle portion.

2. The centrifugal compressor according to claim 1, wherein the flow channel adjacent to the fluid intake is enlarged by tapering the shroud side at a predetermined angle in the shaft direction, and the flow channel adjacent to the fluid outlet of the shroud side or the fluid outlet of the hub side at the circular plate is reduced by tapering the shroud side toward the centrifugal direction at a predetermined angle.

3. The centrifugal compressor according to claim 1, wherein an angle made by a straight line connecting the shroud side of the fluid outlet with the hub side and an edge of the circular plate that is perpendicular to the rotary shaft is in the range of 60° to 90° in a tangential direction of the circular plate.

4. The centrifugal compressor according to claim 1, wherein the shroud side is formed in an S-shape, and the hub side is formed in an S-shape.

5. The centrifugal compressor according to claim 1, wherein a width of the blade is gradually reduced from an end of the fluid discharging side of the flow channel to the downstream.

6. The centrifugal compressor according to claim 5, wherein the end is formed in a cylindrical shape having elliptical surface such that a long axis is arranged in a direction of the flow channel and a short axis is arranged in a width direction of the blade.

7. The centrifugal compressor according to claim 5, wherein the end is formed in a semi-circular cylinder shape.

8. The centrifugal compressor according to claim 5, wherein the end is formed in an edge shape.

9. A centrifugal compressor comprising a rotary shaft, a circular plate supported by the rotary shaft, and a plurality of blades substantially radially disposed and protruding from the circular plate, and having flow channels of a cross sectional area formed between the blades, in order to suck fluid from a front area in a shaft direction by rotating the circular plate with the rotary shaft and then discharge the fluid, which increases in pressure while passing through the flow channels, in a centrifugal direction, wherein, assuming that a blade angle of a shroud side of the blade is a first angle and a blade angle of a hub side disposed at the circular plate is a second angle, the shroud side is formed in a curved shape having a first angle distribution from the front area in the shaft direction toward the centrifugal direction in which the first angle distribution alternately has a local maximum point at which the cross sectional area of the flow channel changes from expansion to reduction and a local minimum point at which the cross sectional area of the flow channel changes from reduction to expansion, and the hub side is formed in a curved shape having a second angle distribution from the front area in the shaft direction toward the centrifugal direction in which the second angle distribution has a local maximum point at which the cross sectional area of the flow channel changes from expansion to reduction that is before a substantially middle portion.

10. The centrifugal compressor according to claim 9, wherein an angle made by a straight line connecting the shroud side of the fluid outlet with the hub side and an edge of the circular plate that is perpendicular to the rotary shaft is in the range of 60° to 90° in a tangential direction of the circular plate.

11. The centrifugal compressor according to claim 9, wherein the shroud side is formed in an S-shape, and the hub side is formed in an S-shape.

12. The centrifugal compressor according to claim 9, wherein a width of the blade is gradually reduced from an end of the fluid discharging side of the flow channel to the downstream.

13. The centrifugal compressor according to claim 12, wherein the end is formed in a cylindrical shape having elliptical surface such that a long axis is arranged in a direction of the flow channel and a short axis is arranged in a width direction of the blade.

14. The centrifugal compressor according to claim 12, wherein the end is formed in a semi-circular cylinder shape.

15. The centrifugal compressor according to claim 12, wherein the end is formed in an edge shape.

16. An impeller of a centrifugal compressor comprising a rotary shaft and an impeller having a plurality of blades substantially radially disposed and protruding from a circular plate supported by the rotary shaft, and having flow channels of a cross sectional area formed between the blades, in order to suck fluid from a front area in a shaft direction by rotating the circular plate with the rotary shaft and then discharge the fluid, which increases in pressure while passing through the flow channels, in a centrifugal direction, wherein, assuming that a blade angle of a shroud side of the blade is a first angle and a blade angle of a hub side disposed at the circular plate is a second angle, the shroud side is formed in a curved shape having a first angle distribution from the front area in the shaft direction toward the centrifugal direction in which the first angle distribution has a local maximum point at which the cross sectional area of the flow channel changes from expansion to reduction that is before a substantially middle portion and has a local minimum point at which the cross sectional area of the flow channel changes from reduction to expansion after the substantially middle portion, and the hub side is formed in a curved shape having a second angle distribution from the front area in the shaft direction toward the centrifugal direction in which the second angle distribution has a local maximum point at which the cross sectional area of the flow channel changes from expansion to reduction that is before the substantially middle portion.

17. A method of operating a centrifugal compressor including a rotary shaft and an impeller having a plurality of blades substantially radially disposed and protruding from a circular plate supported by the rotary shaft and having flow channels formed between the blades in order to suck fluid from a front area in a shaft direction by rotating the circular plate with the rotary shaft and then discharge the fluid, which increases in pressure while passing through the flow channels, in a centrifugal direction, wherein, assuming that a blade angle of a shroud side facing the circular plate of the blade is a first angle and a blade angle of a hub side disposed at the circular plate is a second angle, deceleration flow is promoted at a front half region of the flow channel and acceleration flow is promoted at a rear half region of the flow channel by the impeller that has the shroud side formed in a curved shape having a first angle distribution from the front area in the shaft direction toward the centrifugal direction in which the first angle distribution has a local maximum point at which the cross sectional area of the flow channel changes from expansion to reduction that is before a substantially middle portion and has a local minimum point at which the cross sectional area of the flow channel changes from reduction to expansion after the substantially middle portion, and the hub side is formed in a curved shape having a second angle distribution from the front area in the shaft direction toward the centrifugal direction in which the second angle distribution has a maximum local point before the substantially middle portion.

* * * * *